United States Patent [19]

Snyder

[11] Patent Number: 4,840,284

[45] Date of Patent: Jun. 20, 1989

[54] SLOPED BOTTOM TANK

[75] Inventor: Andrew W. Snyder, Beatrice, Nebr.

[73] Assignee: Hoover Group, Inc., Roswell, Ga.

[21] Appl. No.: 144,376

[22] Filed: Jan. 15, 1988

[51] Int. Cl.[4] ..... B65D 87/00

[52] U.S. Cl. ..... 220/5 A; 220/1 B; 220/1.5; 220/66

[58] Field of Search ..... 220/5 A, 1 B, 1.5, 66

[56] References Cited

U.S. PATENT DOCUMENTS

| | | | |
|---|---|---|---|
| 2,887,251 | 5/1959 | Mackridge | 220/1.5 X |
| 3,130,855 | 4/1964 | Gunn, Jr. | 220/1.5 X |
| 3,162,331 | 12/1964 | Hutchins et al. | 220/1.5 X |
| 3,186,607 | 6/1965 | Lubenow | 220/66 X |
| 4,157,609 | 6/1979 | Schütz | 220/1.5 X |
| 4,173,288 | 11/1979 | Schütz | 220/1.5 |
| 4,605,126 | 8/1986 | Goedken et al. | 220/1 B X |
| 4,648,521 | 3/1987 | Thomas et al. | 220/1 B X |

*Primary Examiner*—Steven M. Pollard

*Attorney, Agent, or Firm*—Harness, Dickey & Pierce

[57] ABSTRACT

A sloped bottom portable tank having a smooth internal bottom surface sloping toward a bottom discharge comprising a rectangular bottom plate having upturned curved side portions merging with upwardly extending wall portions joining the vertical walls of the tank along a horizontal edge. The tank has integral feet at the corners to position the discharge at the lowest point when the tank is vertical and resting on a horizontal surface.

1 Claim, 2 Drawing Sheets

SLOPED BOTTOM TANK

BACKGROUND AND SUMMARY OF THE INVENTION

This invention relates generally to portable tanks and more particularly to a sloped bottom structure of a portable tank adapted for liquid storage and transport.

A large tank for liquid storage generally has a bottom discharge. Construction of a tank having a bottom discharge generally requires affixing legs to the bottom of the tank so as to raise the discharge opening from the ground or the supporting surface on which the tank rests. In order to provide complete drainage of tank contents, either a rounded bottom is provided with a central discharge opening or a side discharge is provided by having internal baffles welded inside the tank to provide an internal surface sloping towards the discharge opening. This latter approach is preferred because discharge connections must be externally made.

It is more convenient to connect hoses, fittings from the side of the bottom rather than trying to reach a central discharge underneath the bottom of a large tank or bin. However, conventional side discharge construction, requiring baffles, does not lend itself to thorough cleaning of the interior surfaces of the tank because of the difficulty of cleaning tank contents from internal crevices created by the baffles. Material deposits tends to accumulate and concentrate in these crevices. These deposits in turn lead to cracking which results in leakage of the tank contents.

It is an object of the present invention to provide a portable tank having a sloped bottom structure that presents a smooth interior surface sloped toward the discharge opening to allow full drainage from the tank.

It is another object of the present invention to provide a portable tank having a sloped internal bottom surface which requires no internal baffles.

A portable tank having a sloped bottom structure according to the present invention has a generally rectangular bottom plate having a discharge opening therethrough. At least two shallow creases or bends directed toward the bottom discharge opening in the plate form the sloped inner surface of the bottom. The sides of the generally rectangular bottom plate are upwardly curved so as to merge with upwardly extending wall portions of the plate which terminate in a substantially horizontal edge. This edge joins with the vertical sidewalls of the tank.

The bottom structure has four feet, each positioned adjacent a corner of the generally rectangular bottom plate. These feet are hollow elliptical cylinders and may be formed from sheet metal stock. Each foot has a horizontal bottom edge and a sculptured upper edge which is contoured to match the curvature of the bottom plate. The feet position the discharge opening at the lowest elevation of the bottom plate when the feet rests on a horizontal surface.

The upper edges of the feet are sculptured to merge with the curved surface of the tank bottom and position the edge of the bottom plate in a horizontal plane when the bottom edges of the feet are positioned in a horizontal plane.

Further objects, features, and advantages of the invention will become evident from a consideration of the following detailed description when taken in conjunction with the accompanying drawings and the appended claims.

DETAILED DESCRIPTION OF THE INVENTION

Figure 1:
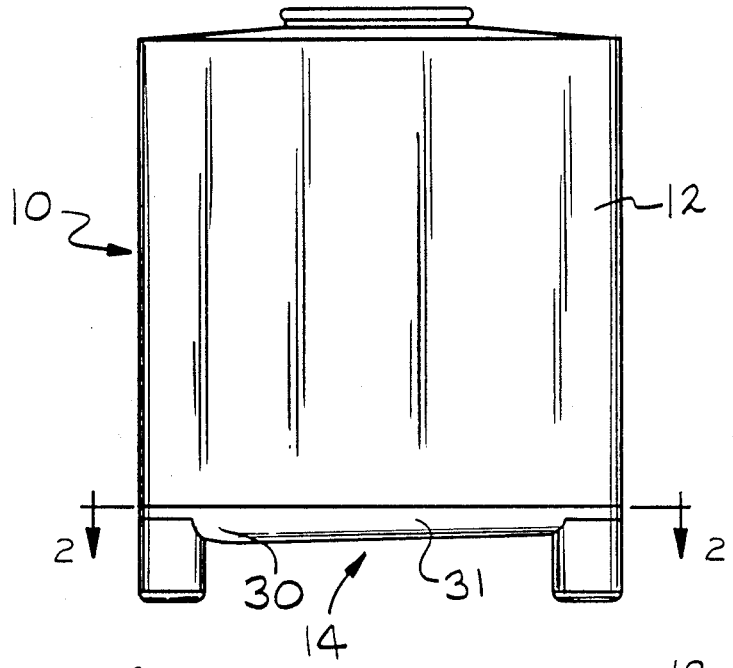
FIG. 1 is a side view of the portable tank of this invention.

Turning now to the drawings, a portable tank 10 for bulk liquid storage and transport according to the present invention is shown in FIG. 1. Tank 10 includes generally vertical side walls 12 and a sloped bottom structure 14. Sloped bottom structure 14 comprises a generally rectangular bottom plate 16 supported by feet 18, 20, 22 and 24 disposed at the corners of plate 16. Bottom plate 16 has two bends or creases 24 and 26 directed toward discharge opening 28 from points near opposite feet 20 and 18 respectively. Sides 30 of plate 16 are upwardly curved so as to merge tangentially with upwardly extending wall portions 31 which terminate in a substantially horizontal edge 32. Edge 32 is in turn joined with vertical side walls 12 of tank 10.

Discharge opening 28 is disposed between feet 22 and 24 and adjacent foot 22. The creases or bends 24 and 26 in the bottom plate 16 form a smooth sloped inner surface to bottom structure 14.

Figure 2:
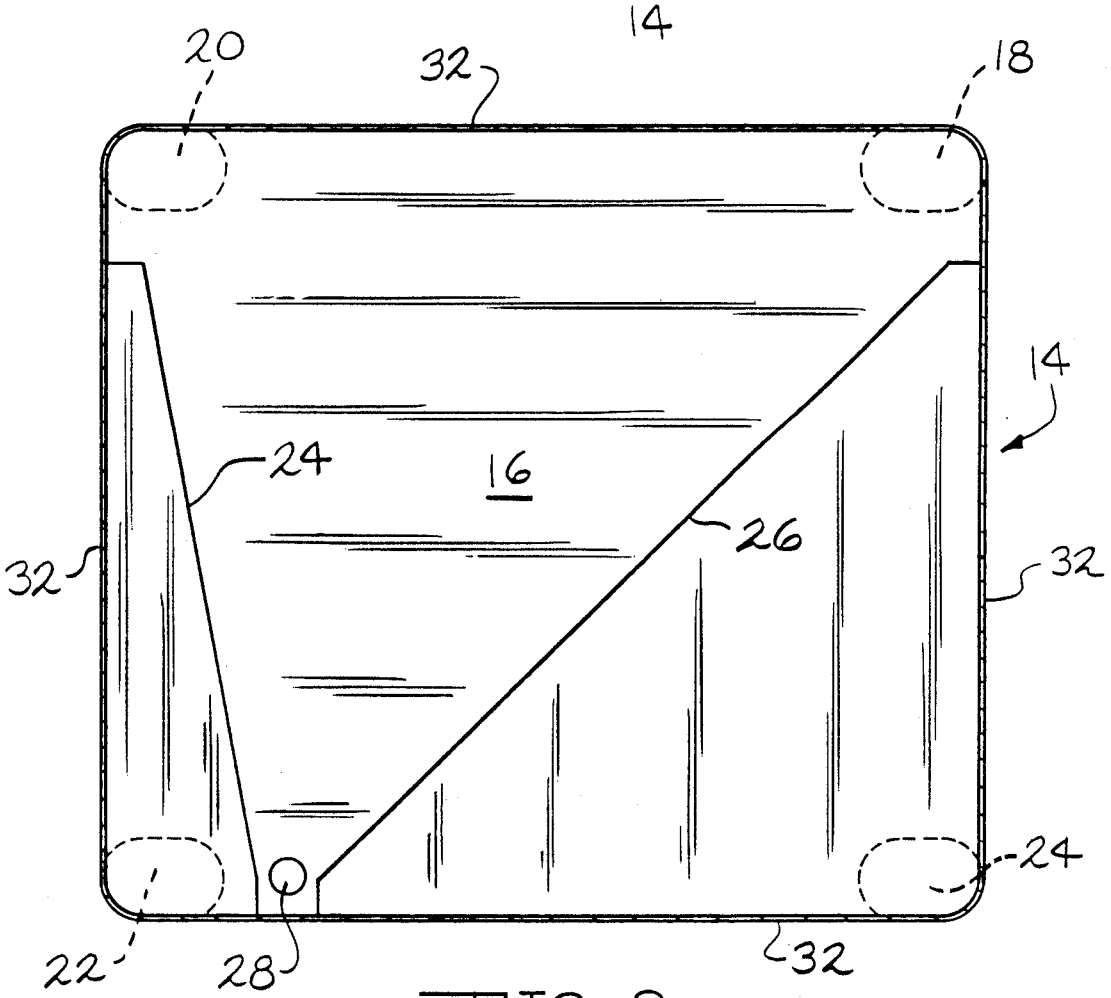
FIG. 2 is a sectional view of the sloped bottom tank according to present invention taken along the line 2—2 in FIG. 1 to present a top plan view of the tank bottom plate.

Discharge opening 28 may be positioned at any location in the bottom plate 16 as required for a particular design. As shown in FIG. 2, opening 28 is adjacent foot 22. Opening 28 could be positioned midway between the feet if required, or at any other position as design dictates. In these cases, the upper edge contours of the feet would be different from those shown so as to maintain the upper edge 32 in a horizontal plane for joinder with tank side walls 12.

Figure 3:
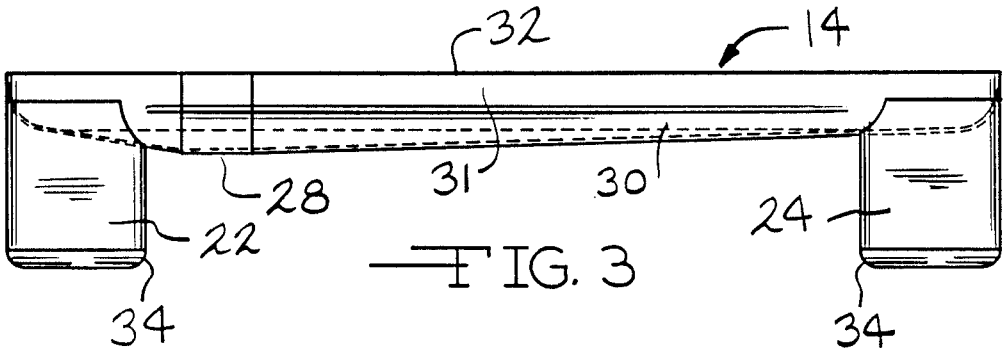
FIG. 3 is a front view of the sloped bottom in the tank of this invention shown in FIG. 1.
Figure 4:
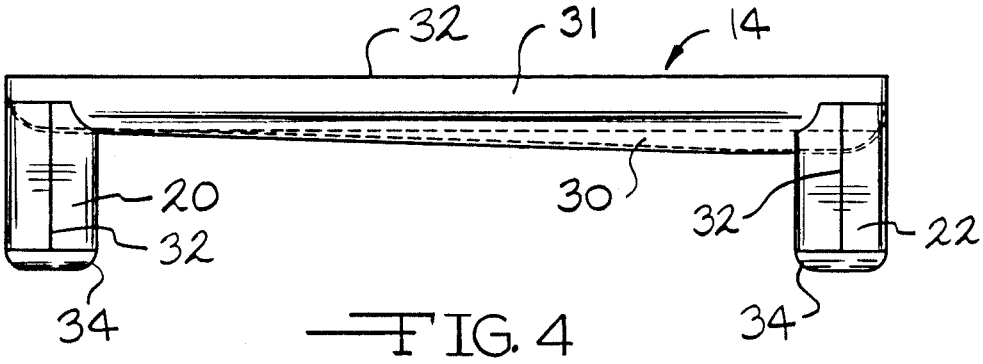
FIG. 4 is a side view of the sloped bottom shown in FIG. 3.
Figure 5:
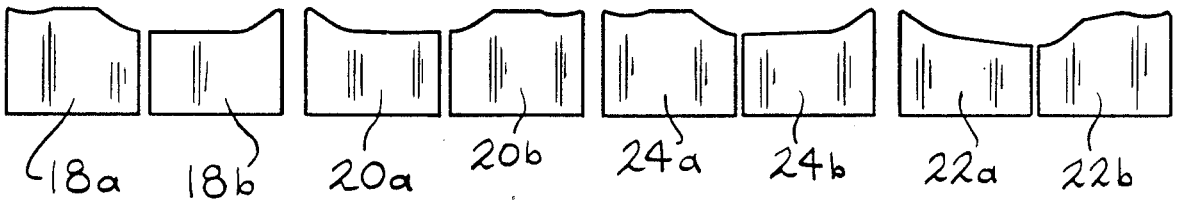
FIG. 5 is a side by side comparison of the foot pieces forming the feet on the sloped bottom shown in FIGS. 3 and 4 illustrating the sculptured contour of the upper edges.
Figure 6:
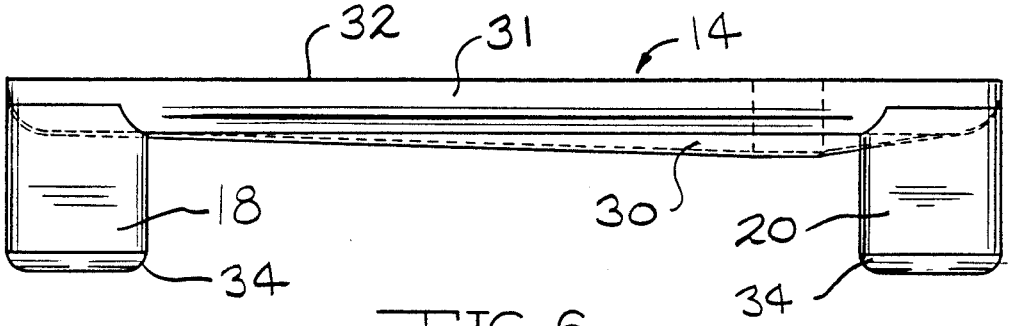
FIG. 6 is an opposite side view of the bottom shown in FIG. 3.

A portion of the upper edge of each foot merges tangentially with the bottom plate 16 as shown in FIGS. 3, 4 and 6. The bottom edges of the feet are straight as shown in FIG. 5. The upper edges are contoured differently depending on the position of each foot.

Feet 18, 20, 22 and 24 may be formed from flat sheet metal stampings. Each foot is formed from two pieces a and b which are bent, placed together to form a cylinder and then welded forming seam 32 as shown in FIG. 4. A support cup 34 is then welded to the formed bottom edge of each foot. Each foot then has a substantially flat bottom and a sculpted top contour to match its particular corner position on sloped bottom plate 16.

As shown in FIG. 5, the upper edges of each foot piece a and b are of slightly differing sculptured contour. Therefore, when the upper edges of the feet are welded to the bottom plate 16 adjacent the appropriate corners of bottom plate 16, the legs 18, 20, 22 and 24 position bottom plate 16 such that upper edge 32 lies in a horizontal plane and discharge opening 28 is at the lowest point in the bottom structure 14. In addition, a portion of the upper edge of each foot merges tangentially with the side 30 of bottom plate 16.

The sloped bottom structure 14 of the present invention provides a smooth inner surface to the tank bottom so as to provide complete drainage of tank contents without the potential for residual pockets of fluid within in the tank at the position of leg joinder and without use of internal baffles as in conventional designs.

The invention has been described above in an illustrative manner and it is to be understood that the terminology which has been used is intended to be in the nature of words of description rather than of limitation. Obviously many modifications and variations of the present invention are possible in light of the above teachings. It is therefore to be understood that within the scope of the appended claims, the invention may be practiced otherwise than as specifically described.

What is claimed is:

1. A portable tank for fluid storage and transport having generally vertical sides and a sloped bottom for complete drainage of fluid from the tank comprising:

a generally rectangular bottom plate having upwardly curved side portions that merge with upwardly extending wall portions that terminate in a substantially horizontal upper edge, said bottom plate having an inner surface and an outer surface and having a discharge opening therethrough, said inner surface having a plurality of smooth contoured surfaces sloped toward said discharge opening and a plurality of creases between said sloped surfaces directed toward said discharge opening to thereby slope substantially all of said inner surface toward said discharge opening, said side walls being mounted on and secured to said upper edge of said bottom plate, said outer surface being contoured like said inner surface, a plurality of feet attached to said outer surface of said plate and positioned at the corners of said plate, each of said feet having a sculptured upper edge conforming in shape to said bottom plate outer surface at the corner of said plate and being secured to said outer surface so that when said feet are resting on a horizontal surface said discharge opening is positioned at the lowest elevation of said bottom plate and said inner surface presents a smooth contoured surface sloping toward said discharge opening.

* * * * *

US004840284B1

REEXAMINATION CERTIFICATE (3012th)

United States Patent [19] [11] B1 4,840,284

Snyder [45] Certificate Issued Oct. 1, 1996

[54] SLOPED BOTTOM TANK

[75] Inventor: Andrew W. Snyder, Beatrice, Nebr.

[73] Assignee: Nationsbank of Georgia, National Association, Atlanta, Ga.

Reexamination Request:
No. 90/003,981, Sep. 29, 1995

Reexamination Certificate for:

| | |
|---|---|
| Patent No.: | **4,840,284** |
| Issued: | **Jun. 20, 1989** |
| Appl. No.: | **144,376** |
| Filed: | **Jan. 15, 1988** |

[51] Int. Cl.[6] ..... B65D 87/00

[52] U.S. Cl. ..... 220/601; 220/1.5; 220/4.12; 220/DIG. 6; 222/460

[58] Field of Search ..... 220/1.5, 571, 601, 220/608, 4.12, 600; 222/460, 4.12

[56] References Cited

U.S. PATENT DOCUMENTS

| | | | |
|---|---|---|---|
| 1,868,799 | 7/1932 | Kramer | 222/460 |
| 3,785,534 | 1/1974 | Smith | 222/460 |
| 4,746,034 | 5/1988 | Ata et al. | 222/143 |

*Primary Examiner*—Steven M. Pollard

[57] ABSTRACT

A sloped bottom portable tank having a smooth internal bottom surface sloping toward a bottom discharge comprising a rectangular bottom plate having upturned curved side portions merging with upwardly extending wall portions joining the vertical walls of the tank along a horizontal edge. The tank has integral feet at the corners to position the discharge at the lowest point when the tank is vertical and resting on a horizontal surface.

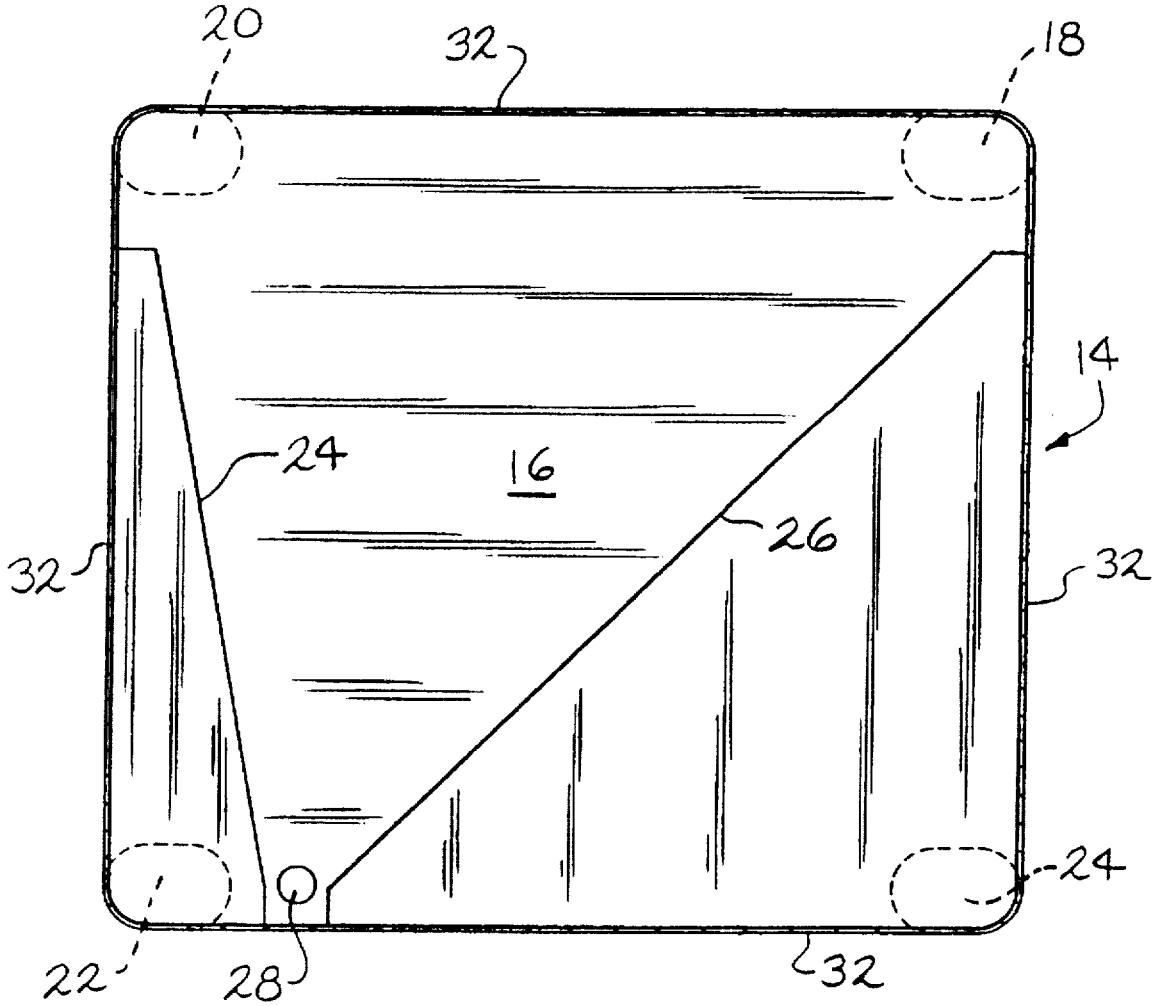

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

1. A portable tank for fluid storage and transport having generally vertical sides and a sloped bottom for complete drainage of fluid from the tank comprising:

a generally rectangular bottom plate having upwardly curved side portions that merge with upwardly extending wall portions that terminate in a substantially horizontal upper edge, said bottom plate having an inner surface and an outer surface and having a discharge opening therethrough, said inner surface having a plurality of smooth contoured surfaces sloped toward said discharge opening and a plurality of creases between said sloped surfaces directed toward said discharge opening to thereby slope substantially all of said inner surface toward said discharge opening,

[said] side walls [being] mounted on and secured to said upper edge of said bottom plate, said outer surface being contoured like said inner surface, a plurality of *hollow, cylindrical* feet attached to said outer surface of said plate and positioned at the corners of said plate, *said discharge opening being located adjacent one of said feet and adjacent one of said walls,* each of said feet having a sculptured upper edge *of a particular shape differing from the shapes of the upper edges of the remaining ones of said plurality of feet, each of said sculptured upper edges* conforming in shape to said bottom plate outer surface at [the] *a* corner of said plate and being secured to said outer surface so that when said feet are resting on a horizontal surface said discharge opening is positioned at the lowest elevation of said bottom plate and said inner surface presents a smooth contoured surface sloping toward said discharge opening.

* * * * *